US005886285A

United States Patent [19]

Will et al.

[11] Patent Number: 5,886,285

[45] Date of Patent: Mar. 23, 1999

[54] VARIABLE RANGE TIMER IMPACT SAFETY SYSTEM

[75] Inventors: Albert S. Will, Bethesda; Robert R. Wilson, Chillum, both of Md.

[73] Assignee: The United States of America as represented by the Secretary of the Navy, Washington, D.C.

[21] Appl. No.: 423,642

[22] Filed: Dec. 28, 1964

[51] Int. Cl.[6] ..... F42C 15/44; F42C 15/40; F42C 9/02

[52] U.S. Cl. ..... 102/206; 102/263; 102/264; 102/216; 89/1.809; 89/5

[58] Field of Search ..... 102/70.2, 71, 78, 102/82, 206, 216, 200, 263, 264; 318/29; 89/1.809, 5

[56] References Cited

U.S. PATENT DOCUMENTS 2,958,282 11/1960 Czajkowski et al. ..... 244/3.14
3,052,162 9/1962 Rovin ..... 89/6.5
3,153,520 10/1964 Morris ..... 102/215
3,157,125 11/1964 Lohmann ..... 102/249
3,218,470 11/1965 Padgett ..... 326/125

*Primary Examiner*—Charles T. Jordan
*Assistant Examiner*—Christopher K. Montgomery

[57] ABSTRACT

An arming system for a missile which prevents destruction of the missile outside of a specified area. The missile may be launched from a submarine, and follow a water-air-trajectory, and includes a variable-range timer acting in conjunction with an impact detection system. The timer drives arming switches to the armed condition after a predetermined time, and then opens the switches after a second predetermined time, which establishes a maximum range for detonation of the missile warhead.

6 Claims, 2 Drawing Sheets

VARIABLE RANGE TIMER IMPACT SAFETY SYSTEM

The invention described herein may be manufactured and used by or for the Government of the United States of America for governmental purposes without the payment of any royalties thereon or therefor.

This invention relates to the art of the arming of ordnance missiles and more particularly to an arming system for a missile which provides a high degree of safety and reliability.

The present invention was developed as part of a submarine launched air to water rocket weapon system although it will be clear from the following detailed description that it may be employed with any ordnance missile. The missile for the aforementioned weapon system is an antisubmarine weapon adapted for launching from a torpedo tube of an attack type submarine. The missile flies a water-air-water trajectory to the vicinity of the target. This type of weapon may be provided with a nuclear warhead and for this reason it is advantageous to incorporate certain safety features for the protection of the launching submarine and friendly forces in its vicinity as well as those located beyond the target. One of the conditions, for example, which is dictated in order to satisfy the desired safety requirements is that a self-destruction feature not be employed; rather, a wayward missile becomes a dud.

The present application is not directed to the overall safety arming system for the missile, but to that portion thereof which provides for range safety.

An object of the present invention is to provide a safety system which will make use of the known flight time of the missile for a particular range and a sensing of the instant that the missile re-enters the water environment in order to discriminate between normal and abnormal flights.

Another object of the invention is to provide a delayed arming system for an ordnance missile in which the delay time is continuously variable with respect to the range of the desired target.

Still another object of the invention is the provision of a safety system for an ordnance missile which will arm the missile after a delay interval which may be selectively varied as desired up to the instant that the missile is launched.

Another object of the invention is to provide a safety system for a missile which will arm the missile only if it re-enters the water environment in a narrow zone between a set minimum and a maximum range.

A further object of the invention is to provide a safety arming system for a missile which utilizes a variable-range timer in conjunction with an impact detecting system to sense the impact of the weapon on the water surface and wherein additional safety features are provided for the system itself, including instrumentalities to prohibit launching of the missile if the timer fails to operate.

The objects of the invention are accomplished by a variable-range timer which drives arming switches to the armed condition after a predetermined time set into the timer by the fire control for the missile prior to launch and which opens the arming switches after an additional predetermined time, in order to establish the maximum range for the armed condition. The timer is driven by an electric motor. An impact switch is employed in the power circuit for the motor to open the circuit at the moment of impact of the missile with the water. In the event impact occurs prior to the minimum arming time, the switches will not have reached the armed state, and in the event that the impact occurs beyond the maximum time, the switches will have been restored to the unarmed state.

Other objects, advantages and novel features of the invention will become apparent from the following detailed description when taken in conjunction with the accompanying drawings wherein.

Figure 1:
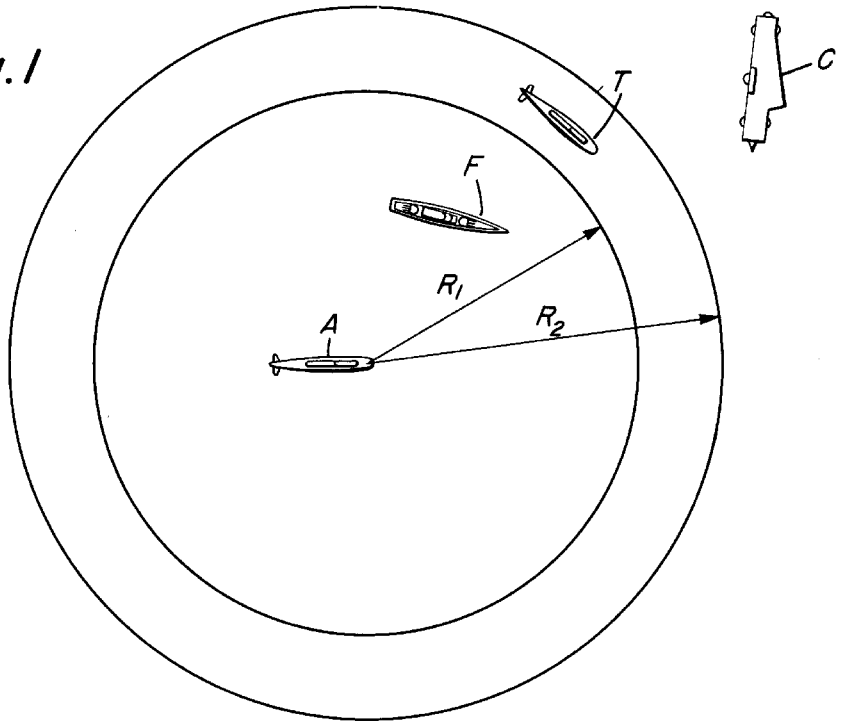
FIG. 1 is a pictorial representation of an exemplary tactical situation.

In order to enable a clear understanding of the intended use of the present invention and its novel operation, FIG. 1 has been provided to show a typical tactical situation in which the present invention is to be used. Referring to FIG. 1, A indicates an attack submarine equipped with a missile. The intended target is the submarine T. Ship F represents a friendly ship lying between the attack submarine and the target, and ship C represents friendly forces lying beyond the target in the general line of fire. In order to protect the friendly forces and the launching submarine itself, the system of the present invention is employed to restrict the zone of arming of the weapon to a narrow annular area overlying the target, indicated in the figure as between radii $R_1$ and $R_2$. It is pointed out here that no consideration of the bearing of the target from the attack submarine is made by the present safety system.

Figure 2:
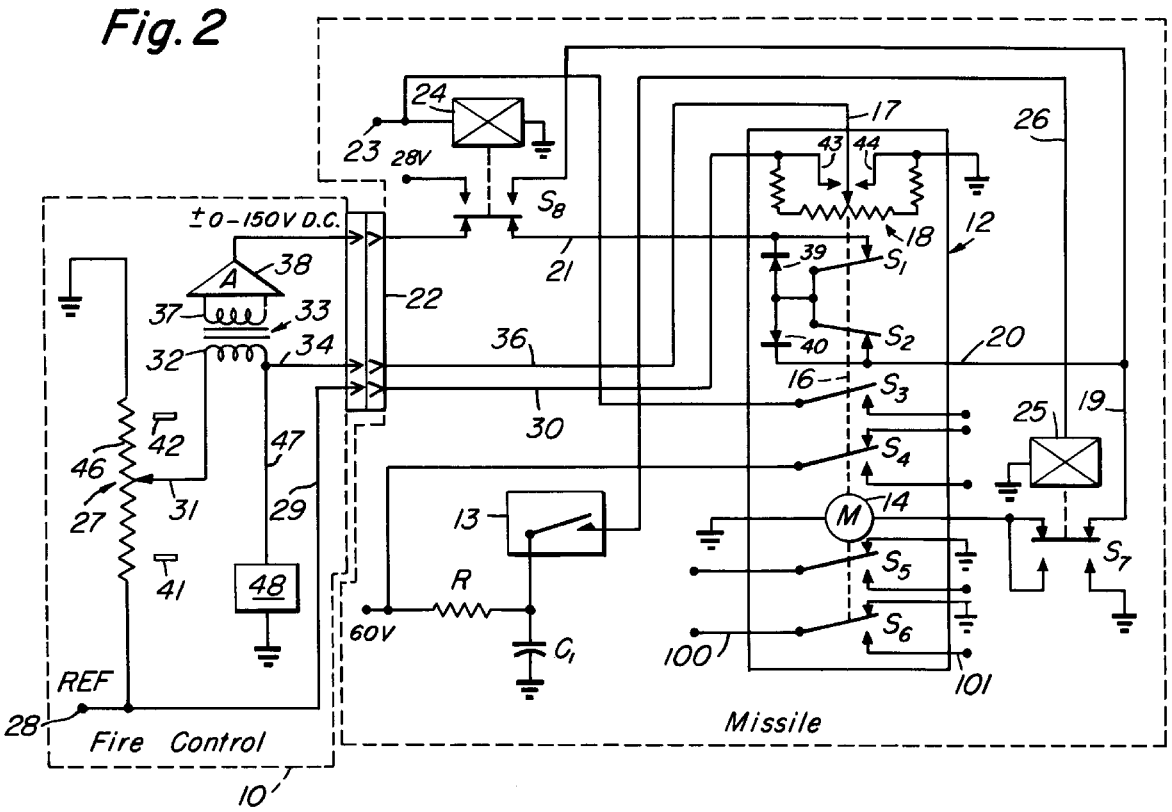
FIG. 2 is a schematic electrical diagram of the present invention.

Referring now to FIG. 2, the electrical circuitry of the present invention is shown as contained partially in the fire control 10 within the launching submarine, and partially within the missile itself, as indicated at 11. The two major elements within the missile 11 are the variable-range timer 12 and an impact switch 13 of the so-called omnidirectional type as described for example in the Richard U.S. Pat. No. 2,741,674, issued Apr. 10, 1956. Variable range timer 12 contains a d.c. permanent magnetic motor 14 with an integral planetary gear reduction box which actuates, through a mechanical connection 16, a plurality of switches $S_1$, $S_2$, $S_3$, $S_4$, $S_5$ and $S_6$ as well as the movable wiper 17 of a potentiometer 18 which is a portion of the range-setting servo-loop. The purpose and operation of the various switches will be described hereinafter.

Prior to launch, current is supplied to motor 14 from the fire control system by way of switch $S_7$, lead 19, lead 20, switches $S_2$ and $S_1$, lead 21, switch $S_8$, and a break-away connector 22. After launch the current for the motor 14 is supplied from a 28 volt source in the missile by way of switch $S_8$ and lead 19. The firing pulse that is employed to start the rocket motor for the missile is also applied at terminal 23 to an explosive motor 24 in switch $S_8$ to connect motor 14 to the 28 volt power supply. Switch $S_7$ in the motor circuit also has an explosive motor 25 which is connected via lead 26 to the omnidirectional impact switch 13. Both switch $S_7$ and switch $S_8$ may be of the type shown in the Leaman U.S. Pat. No. 2,931,874, issued Apr. 5, 1960. Switch 13 is operative to provide a firing pulse to explosive motor 25 upon impact of the missile with the water by discharging a capacitor $C_1$ through explosive motor 25. $C_1$ is previously charged through resistor R from a 60 volt source.

In order to set the desired time into the variable-range timer 12, the fire control system is provided with the transmitting potentiometer 27 of the aforementioned potentiometer servo-loop and an a.c. reference voltage is applied from the submarine's power supply at terminal 28. One side of potentiometer 27 is connected to one side of potentiometer 18 through lead 29, breakaway connector 22, and lead 30 while the other side of potentiometer 27 is connected to the other side of potentiometer 18 through ground. The diagonal of the resulting bridge circuit is comprised of the transmitting wiper 31, which is set by the fire control to a setting representative of the desired time, the primary winding of a transformer 33, lead 34, breakaway connector 22, and lead 36 to the aforementioned receiving wiper 17, the position of which is controlled by motor 14 through mechanical connection 16. The secondary 37 of transformer 33 is connected through an amplifier 38, having suitable rectifying circuitry therein, and the breakaway connector 22 to switch $S_8$ and both switches $S_1$ and $S_2$ to provide the setting current for motor 14.

Various means are provided in this circuitry for protecting against inadvertent setting of the timer to dangerous times, that is, those which are too short or too long. First, mechanical stops 41 and 42 are provided in the transmitting potentiometer 27 in order to limit the travel of wiper 31. One of the stops, 41, is set at the maximum range setting of the potentiometer while the other, 42, is at the minimum range setting. A second safety device is provided at the receiving potentiometer 18. Here, two contacts 43 and 44 are provided which are positioned to be contacted by wiper 17 at its minimum and maximum range positions, respectively. When wiper 17 reaches the minimum range contact 43 for example it is apparent that the lower leg 46 of potentiometer 27 is directly shorted, and it is impossible to null the circuit. This condition is sensed by an interlock 48 in the launch mechanism which is connected into the present circuit by means of lead 47. Interlock 48 is shown in block diagram form only since the details thereof are not critical to the operation of the present system. Suffice it to say that interlock 48 performs two basic functions. When the wiper 17 is against either of the stops 43 or 44 and the servo cannot proceed to a null position, this fact is sensed by interlock 48 and the launching of the missile is prohibited. The voltage across the ground leg 46 of potentiometer 27 is also monitored and if it is below a certain minimum value, indicating that too short a time has been set in, launching is also prohibited.

Switches $S_1$ and $S_2$ in the timer are limit switches which are provided as an additional safety measure to prevent the operation of motor 14 if the other safety means either fail to operate or are overridden. Switches $S_1$ and $S_2$ are intended to be cam operated, and depending on the position and structure of the cams, the switches are arranged to be both open, both closed, or one open and the other closed, depending on the time set in. It is apparent from an examination of FIG. 2 that it is necessary for the condition to be such that both of the switches are closed to operate motor 14 in both directions, and this condition is to be provided by the cam only when safe time is set. A fire control signal of ±0 to 150 volts output from amplifier 38 is applied to the motor via switches $S_1$ and $S_2$. If a positive fire control voltage calls for a time setting slightly less than that for the minimum range, the timer motor drives a cam to open switch $S_1$, stopping the motor. Diode 39 cannot conduct because of voltage polarity. Thus a null cannot be obtained, and missile firing is prevented by monitor 48. When the fire control generates a negative voltage, it is applied to the motor via diode 39 bridging the open switch $S_1$. The motor then runs in the reverse direction to permit switch $S_1$ to close, and to return the timer to its safe settable zone. The converse is true for the maximum range limit involving switch $S_2$ and diode 40.

FIGS. 3–6 illustrate the physical structure of a variable timer which may be employed in the present system. It is to be understood that the timer as shown is merely exemplary and its use is not necessary to the present invention. Other and different structures may also be employed.

Motor 14 is shown in FIG. 2 as located in a cylindrical plastic housing 48. Numeral 49 indicates the casing of a high ratio reduction gearing system between motor 14 and output shaft 50. Motor housing 48 is a molded plastic body and has provision thereon for the attachment of a continuation housing 51 and various switch support elements 52, 53, 54, 56, 57, 58 and 59. All of these elements are made of a suitable plastic material and are secured together by means of screws such as shown at 60 and 61 which engage an internally threaded sleeve 62 molded into housing 48. At the end of shaft 50 and secured to support 52 by means of fasteners 63 is a housing 64 for the potentiometer 18. It is to be understood that shaft 50 enters the potentiometer housing and actuates wiper 17 therein.

Figure 6:
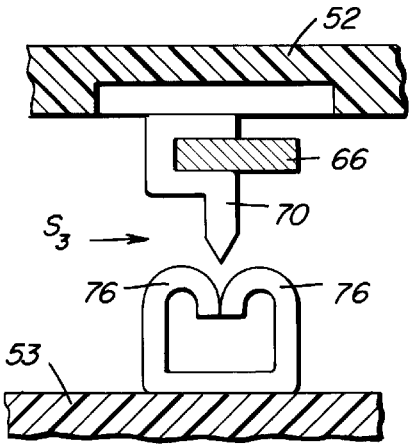
FIG. 6 is a detail showing of one of the switches of the invention.

Switches $S_1$, $S_2$ and $S_3$ are directly cam operated by means of a cam 65 which is fixed on shaft 50 to rotate therewith. Each of switches $S_1$, $S_2$ and $S_3$ is an opposed leaf spring knife switch having the knife thereof on one side and the spring finger stationary contact on the other as indicated in FIG. 6. As is apparent from a comparison of FIGS. 3, 4 and 6 half of each of switches $S_1$, $S_2$ and $S_3$ is mounted on disc 53. The opposite halves of each of the switches is mounted on element 52. Switches $S_1$ and $S_2$ illustrate in FIG. 4 the knife portion of the switches. Each comprises an L-shaped leaf spring blade 66 secured to disc 53 by means of suitable rivets 67. Electrical connection is made to the switches by means of an upstanding lug 68 on each leaf spring to which a suitable lead 69 is soldered. Knives 70 are secured to blades 66 in any suitable manner. Blades 66 overlay an undercut recess 71 to allow for flexure of the blades. The free ends of the blades terminate in cam follower hemispheres 72.

Figure 4:
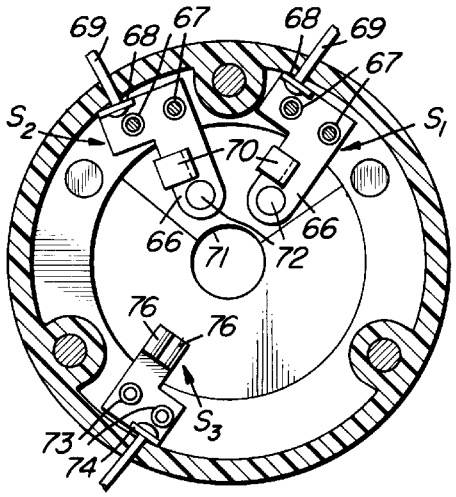
FIG. 4 is a section taken along line 4—4 of FIG. 3.

Switch $S_3$ in FIG. 4 illustrates the structure of the stationary contact. This again is an L-shaped blade secured to the base of disc 53 by means of suitable rivets 73. Electrical connection is made to an upstanding lug 74. The free end of the L-shaped member terminates in opposed spring fingers 76 which are engaged by the knife 70 of the opposite member in the closed position of the switch. In order to operate switches $S_1$ and $S_2$, cam 65 is provided with a surface 76, a ramp 77 and a surface 78. On the opposite side of the cam, as shown in FIG. 2 and used to operate switch $S_3$, are a second set of surfaces and ramp, in this case surface 79, ramp 81 and surface 80. It will be clear from a consideration of the structure of cam 65 that the operation of the various switches is as follows. When surface 76 on cam 65 overlies the followers 72 of switches $S_1$ and $S_2$, the switches are in their uppermost or closed position. Ramp 77 and surface 78 operate to move the switches to their lowermost position and retain them there in their open position.

It will be understood that surfaces 79 and 80 and ramp 81 act in a similar manner to operate the movable contact of switch $S_3$.

Figure 3:
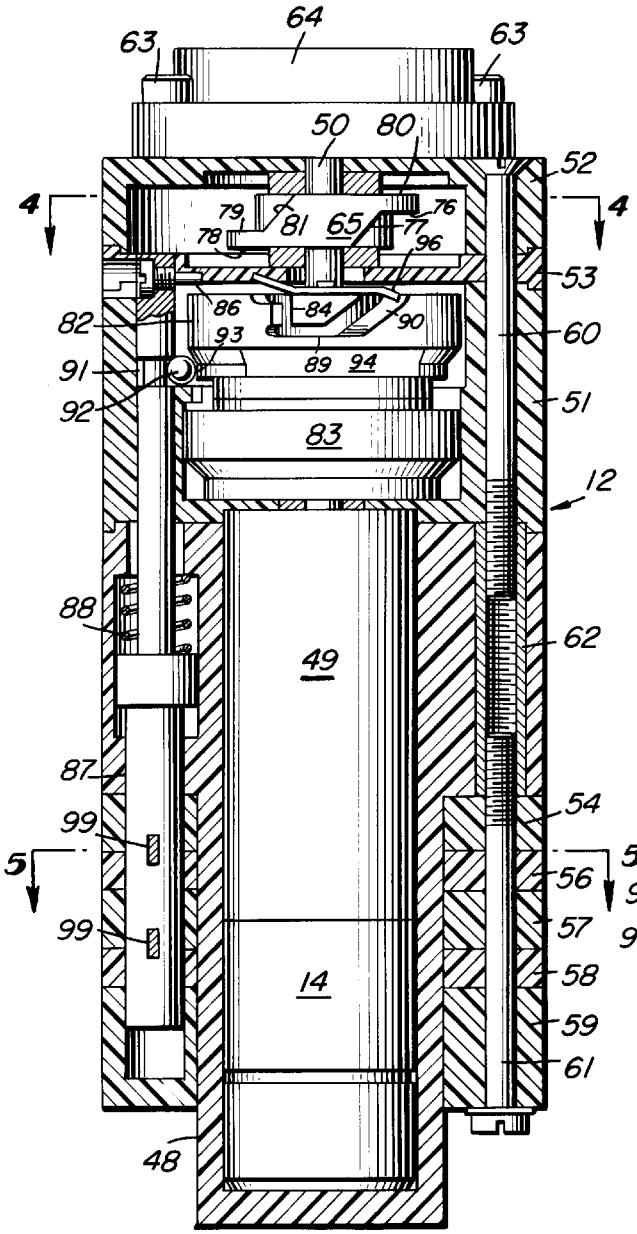
FIG. 3 is a vertical cross-section through a variable-range timer which may be used in the system of the present invention.
Figure 5:
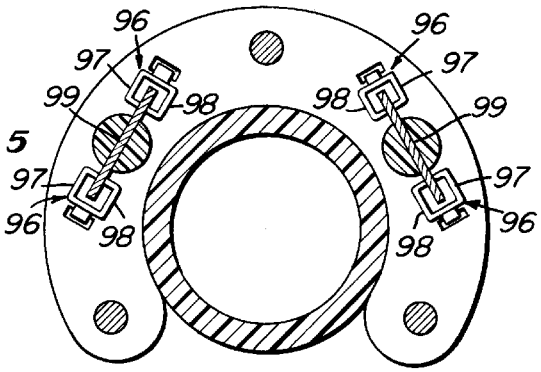
FIG. 5 is section taken along line 5—5 of FIG. 3.

Switches $S_4$, $S_5$ and $S_6$ are cam operated snap-action switches. One typical switch is shown in FIGS. 3 and 5 and it is to be understood that the other two switches are constructed in the same manner. In the arrangement as shown in FIG. 3, one typical cam disc is shown at 82. Disc 83 is similar but the cam surface thereof is displaced by the angle between the individual switches and does not appear in FIG. 3. Each of these cam discs is secured to shaft 50 for rotation therewith by motor 14, and serves to control the position of a switch actuating rod 87 having a transversely extending cam follower 86.

The construction of the cam slot in cam disc 82 is as follows. First, there is a drop-in slot 84 into which cam follower 86 of rod 87 will fall under the action of a spring 88 when the drop-in slot has been rotated to the position of rod 87. A horizontal slot 89 then connects the bottom of drop-in slot 84 with a resetting ramp 90 which returns rod 87 to its uppermost position after an additional time determined by the angular extent of slot 89.

Means are provided for holding cam follower 86 above the top surface of the cam disc 82 during the resetting portion of the cycle of operation of the present device. This means consists of a reduced diameter portion 91 on rod 87 defining a shoulder which cooperates with a ball 92, biased toward rod 87 by means of a surface 93 on cam disc 82. Just prior to the arrival of drop-in slot 84 at the position of rod 87, a recessed portion 94 begins, which allows ball 92 to be biased away from rod 87 by the downward action of spring 88. After rod 87 has been reset by ramp 90, ball 92 is again biased to the left in FIG. 3 to raise follower 86 off the surface of the cam.

A leaf spring element 95 is secured to the top surface of disc 82 and overlies the cam slots 84 and 90. Leaf spring 95 is depressed somewhat into slot 90 so as to permit the cam follower to ride up on the top surface on element 95 when the cam is operated inadvertently in a counterclockwise direction. The opposite end of leaf spring element 95 is bent above the top surface of cam 82 in order to allow cam follower 86 to pass below element 95 to drop into drop-in slot 84.

The switch elements themselves are carried by horseshoe shaped discs 54, 56, 57, 58 and 59 as shown in FIGS. 3 and 5. The stationary contacts 96 of the various switches are formed from sheet stock and are shaped to provide opposed spring fingers 97 and 98 respectively (see FIG. 5). In order to bridge between fingers 97 and 98 to connect contacts 96 electrically, rod 87 is provided with a transversely extending bar 99, which in the uppermost position of rod 87 is withdrawn from position between the spring finger elements of the contacts 96 and in the lower position of rod 87 is pressed between the fingers. There are two bars 99 shown in FIG. 3 to actuate two of the switches of switches $S_4$, $S_5$ and $S_6$ the second actuating rod 87 carrying a single bar 99 for operating the remaining switch.

The purpose and operation of switches $S_1$ and $S_2$ has already been described. The purposes of switches $S_3$ to $S_6$ are to perform particular arming functions in the weapon, a knowledge of which is not necessary to an understanding of the present invention but which may be helpful for purposes of clarity. Switch $S_3$, for example, is a two-position switch which serves to control the depth at which the warhead detonates after it has entered the water. For short range use, it is desired that the weapon detonate at a shallow depth for increased safety to the launching submarine. For long ranges, this safety factor is not required and the depth at which the warhead detonates is chosen to be deep in order to provide for maximum effectiveness. One position of switch $S_3$ designates one of these conditions and the other position designates the other, and under the control of cam 65, switch $S_3$ establishes the firing depth. Switch $S_4$ connects the 60 volt source to other parts of the safety system and $S_5$ provides circuit continuity for the power supply ignition. Switch $S_6$ provides the primary warhead arming signal by establishing connection between leads 100 and 101.

The operation of the device should now be readily apparent. Upon receiving information as to the range of the intended target, the firing controlled system will use this range information to set the variable timer to establish the minimum arming distance $R_1$. It should be understood that the range information will be continuously changing in the normal operation of the system and that the servosystem will operate to continuously vary the setting of the variable timer up until the instant that it is desired to launch the missile. During this time, the ignition signal has not been applied to terminal 23 so that switch $S_8$ is in its lowermost position to connect the motor 14 to the amplifier 38 in the fire control system. As the wiper 31 is positioned in accordance with the range information, motor 14 will operate to rotate shaft 50 to position cam disc 82 and 83 to a position which is representative of the desired time interval. It is assumed here that the setting operation has taken place correctly and that none of the safety devices such as contacts 43 and 44 were called into play. When it is desired to launch the missile, and if the timer has been properly set, the interlock 48 allows the firing pulse to be applied to ignite the rocket motor and launch the weapon. Application of the rocket motor ignition pulse to terminal 23 actuates explosive motor 24 to change the position of switch $S_8$. This applies the 28 volt power to motor 14 in order to drive it at its predetermined rate.

Under conditions of normal flight, where the missile re-enters the water environment within the annular arming zone, cam follower 86 will have dropped into slot 84 and be positioned somewhere in the bottom of slot 89. At that time the impact switch disconnects the power from motor 14 by changing the position of switch $S_7$. Under these conditions, the actuating rods 87 are for all practical purposes positively locked in the down position. The rod cannot reciprocate because of the impediment of the walls of slot 89 and the cam discs cannot be rotated by outside forces because of the high resistance of the gearing 49 to rotation of the output shaft 50.

In the event that an abnormal flight occurs and the missile re-enters the water environment prior to reaching the minimum distance, the cams will not have rotated far enough to allow rod 87 to drop into slot 84. Impact switch 13 would then cut off motor power and the switches would be retained in the unarmed position. If the abnormality is such as to cause the missile to overfly the target area, then the cam follower 86 on rod 87 would have dropped into the slot 84, traversed slot 89, and carried up reset ramp 90 back to the top surface of cam 82. Impact switch 13 then in cutting off the timer motor power would leave rod 87 again in the unarmed position.

It can therefore be seen that the present safety system meets all of the objects of the invention as mentioned in the introductory remarks above.

Moreover, it is apparent that the system is fail-safe in that unsafe times cannot be set in and the system fails in the unarmed condition if power is inadvertently cut off. Parts have been reduced to a minimum, the same motor being employed for both setting and timing for example. Overall, the system is highly reliable.

It is to be understood that within the scope of the appended claims the invention may be practiced otherwise than as herein specifically described.

What is claimed is:

1. A safety arming system for a missile having a warhead, intended to be launched at a known velocity against a target at a known range, comprising means for arming said warhead during a predetermined fixed time interval, the beginning of said interval being varied commensurate with said known range, wherein said arming means is a variable timer having an arming switch, means for closing said arming switch at the beginning of said interval and means for opening said arming switch at the end of said interval, and means for disabling said arming means in the event that said missile impacts prior to or subsequent to said interval thereby limiting arming to an annular zone overlying the intended target.

2. An arming system as recited in claim 1 wherein said variable timer is actuated by an electric motor and said disabling means is a switch in the power circuit of said motor which is responsive to an impact of said missile to cut off the power from said motor.

3. An arming system as recited in claim 2 wherein said disabling switch is an omnidirectional impact switch.

4. An arming system as recited in claim 2 wherein the variable timer is adjusted by means of a potentiometer servosystem comprising a rebalancing bridge having a transmitting potentiometer and a receiving potentiometer, each potentiometer having a movable wiper therein, said motor being electrically coupled to the wipers of said potentiometers for control thereby and mechanically connected to said receiving potentiometer wiper and responsive to unbalance of said bridge to drive said timer to the desired adjusted position.

5. An arming system as defined in claim 4 wherein safety means are provided in said servosystem to prevent the setting in of dangerous times, said safety means comprising mechanical stops in said transmitting potentiometer, said stops being positioned at the minimum safe-range and maximum safe-range positions of the transmitting potentiometer wiper, electrical contacts in said receiving potentiometer positioned to be contacted by the wiper thereof in its minimum and maximum safe range positions, said contacts communicating electrically with the respective ends of the potentiometer to provide a short circuit across one bridge arm when contacted by the wiper so as to establish a permanently unbalanced condition in said bridge, and means for sensing the presence of the permanently unbalanced condition and preventing the launching of the missile.

6. An arming system as recited in claim 5 wherein said motor is a d.c. motor and wherein an additional safety means is provided in said timer to prevent operation of said motor in the event that the other safety means do not operate or are overridden, said additional safety means comprising, two cam-operated limit switches in said timer, connected in series in the motor circuit of said bridge, two diodes arranged in back-to-back relation, each being connected across one of said limit switches, and cam means rotated by said motor for operating said limit switches, the cam design being such that both switches are closed only within the range of safe times in said timer, whereby if said motor runs beyond the range of safe times in either direction, one of said switches will be opened to stop the motor.

* * * * *